US009653019B2

(12) United States Patent
Kang

(10) Patent No.: US 9,653,019 B2
(45) Date of Patent: May 16, 2017

(54) DISPLAY DEVICE

(71) Applicant: Samsung Display Co., Ltd., Yongin, Gyeonggi-Do (KR)

(72) Inventor: Hyun-Suk Kang, Asan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 160 days.

(21) Appl. No.: 14/730,902

(22) Filed: Jun. 4, 2015

(65) Prior Publication Data

US 2016/0098958 A1 Apr. 7, 2016

(30) Foreign Application Priority Data

Oct. 1, 2014 (KR) ..... 10-2014-0132411

(51) Int. Cl.
*G09G 3/30* (2006.01)
*G09G 3/3208* (2016.01)

(52) U.S. Cl.
CPC ... *G09G 3/3208* (2013.01); *G09G 2300/0814* (2013.01); *G09G 2320/029* (2013.01); *G09G 2320/0223* (2013.01); *G09G 2320/0233* (2013.01); *G09G 2320/043* (2013.01)

(58) Field of Classification Search
CPC ..... G09G 3/3208
USPC ..... 345/78
See application file for complete search history.

(56) References Cited

U.S. PATENT DOCUMENTS

2003/0123007 A1* 7/2003 Choi ..... G02F 1/13458 349/139
2004/0017531 A1* 1/2004 Nagata ..... G02F 1/1309 349/139
2005/0128417 A1* 6/2005 Song ..... G02F 1/134363 349/150
2009/0278866 A1 11/2009 Kim
2010/0002023 A1 1/2010 Mitsuru et al.
2010/0259527 A1* 10/2010 Odawara ..... G09G 3/3233 345/211
2012/0086694 A1 4/2012 Tseng et al.
2012/0249514 A1 10/2012 Ahn
(Continued)

FOREIGN PATENT DOCUMENTS

KR 10-2009-0116874 A 11/2009
KR 10-2010-0003459 A 1/2010
KR 10-2012-0111675 A 10/2012

*Primary Examiner* — Jason Olson
(74) *Attorney, Agent, or Firm* — Knobbe Martens Olson & Bear LLP

(57) ABSTRACT

A display device is disclosed. The device includes a display panel including a plurality of pixels including a first pixel electrically connected to a first data line and a second pixel electrically connected to a second data line. The display device also includes a current path switch configured to electrically connect the first pixel to the second pixel during a voltage drop test operation and electrically disconnect the first pixel from the second pixel during an image display operation. The display device further includes a voltage drop detector electrically connected to an end of the first data line and an end of the second data line, the voltage drop detector being configured to apply a test voltage to the end of the first data line and measure a dropped test voltage at the end of the second data line. The display device additionally includes a line resistance calculator.

20 Claims, 7 Drawing Sheets

(56) References Cited

U.S. PATENT DOCUMENTS

2015/0379910 A1* 12/2015 Nishinohara ..... G09G 3/006
345/206

* cited by examiner

DISPLAY DEVICE

CROSS REFERENCE TO RELATED APPLICATION

This application claims priority from and the benefit of Korean Patent Applications No. 10-2014-0132411, filed on Oct. 1, 2014 in the Korean Intellectual Property Office (KIPO), the disclosure of which is hereby incorporated by reference herein in its entirety.

BACKGROUND

Field

The described technology generally relates to a display device.

Description of the Related Technology

An electronic system transmits an electrical signal through a line connected between processing elements. In this, the electrical signal can be generated by changing voltage levels.

A pixel in a display device receives a data voltage which has been generated by a data driver and fed through a data line. The pixel then emits light based on the magnitude of the data voltage.

SUMMARY OF CERTAIN INVENTIVE ASPECTS

One inventive aspect is a display device minimizing luminance change due to a voltage drop of a data voltage.

Another aspect is a display device that comprises a display panel including a plurality of pixels, a display panel driver configured to drive the display panel, a timing controller configured to control the display panel driver, a current path switch configured to connect a first pixel which is connected with a first data line to a second pixel which is connected with a second data line during a voltage drop test operation, and to separate the first pixel from the second pixel during an image display operation, the first and second pixels being located in the same row, a voltage drop detector connected to an end of the first data line and an end of the second data line, configured to apply a test voltage to the end of the first data line, and configured to measure a dropped test voltage at the end of the second data line, and a line resistance calculator configured to calculate a first line resistance of the first data line from the end of the first data line to the first pixel, and to calculate a second line resistance of the second data line from the end of the second data line to the second pixel.

In example embodiments, the display panel driver provides a first compensated data voltage to the first pixel based on the first line resistance to compensate a first data voltage which is provided to the first pixel, and provide a second compensated data voltage to the second pixel based on the second line resistance to compensate a second data voltage which is provided to the second pixel.

In example embodiments, the display panel is divided into a first area and a second area by a virtual reference line, and the first and second pixels are included in the first area.

In example embodiments, a third pixel connected to a third data line in the second area and a symmetrical pixel in the first area are substantially symmetric with respect to the virtual reference line.

In example embodiments, the line resistance calculator estimates that a third line resistance of the third data line from an end of the third data line to the third pixel is substantially the same as a symmetrical resistance of a symmetrical data line from an end of the symmetrical data line to the symmetrical pixel, the symmetrical data line being connected to the symmetrical pixel.

In example embodiments, the display panel driver provides a third compensated data voltage to the third pixel based on the symmetrical resistance to compensate a third data voltage which is provided to the third pixel.

In example embodiments, the line resistance calculator estimates a fourth line resistance of a fourth data line from an end of the fourth data line to a fourth pixel by an interpolation based on between the first line resistance and the second line resistance.

In example embodiments, the display panel driver provides a fourth compensated data voltage to the fourth pixel based on the fourth line resistance to compensate a fourth data voltage which is provides the fourth pixel.

In example embodiments, the display panel is divided into a first area and a second area by a virtual reference line, and the first, second, and fourth pixels can be included in the first area.

In example embodiments, a fifth pixel connected to a fifth data line in the second area and a symmetrical pixel in the first area are substantially symmetric with respect to the virtual reference line.

In example embodiments, the line resistance calculator estimates that a fifth line resistance of the fifth data line from an end of the fifth data line to the fifth pixel is substantially the same as a symmetrical resistance of a symmetrical data line from an end of the symmetrical data line to the symmetrical pixel, the symmetrical data line being connected to the symmetrical pixel.

In example embodiments, the display panel driver provides a fifth compensated data voltage to the fifth pixel based on the symmetrical resistance to compensate a fifth data voltage which is provided to the fifth pixel.

In example embodiments, the line resistance calculator is included in the timing controller.

In example embodiments, the line resistance calculator is included in the display panel driver.

In example embodiments, the display panel driver includes a scan driver configured to provide a first scan signal to the first pixel and provide a second scan signal to the second pixel, and a data driver including the voltage drop detector.

Another aspect is a display device that comprises a display panel driver connected to a plurality of data lines, a timing controller configured to control the display panel driver, a display panel including a plurality of pixels connected to the respective data lines, the pixels having a plurality of resistance detection reference pixels and a plurality of normal pixels, a line resistance detector configured to detect a plurality of first line resistances of the respective data lines from the data driver to the respective resistance detection reference pixels, and a line resistance calculator configured to calculate a plurality of second line resistances of the respective data lines from the data driver to the respective normal pixels based on the first line resistances.

In example embodiments, the line resistance calculator is included in the display panel driver.

In example embodiments, the line resistance calculator is included in the timing controller.

In example embodiments, the display panel driver respectively provides a plurality of first compensated data voltages to the resistance detection reference pixels based on the respective first line resistances compensate a plurality of first data voltages which are respectively provided to the resistance detection reference pixels, and respectively provide a plurality of second compensated data voltages to the normal pixels based on the respective second line resistances to compensate a plurality of second data voltages which are respectively provided to the normal pixels.

In example embodiments, the line resistance calculator estimates the second line resistances by an interpolation based on the first line resistances.

Another aspect is a display device, comprising a display panel including a plurality of pixels comprising a first pixel electrically connected to a first data line and a second pixel electrically connected to a second data line, wherein the first and second pixels are located in the same row. The display device also comprises a display panel driver configured to drive the display panel, a timing controller configured to control the display panel driver, and a current path switch configured to i) electrically connect the first pixel to the second pixel during a voltage drop test operation, and ii) electrically disconnect the first pixel from the second pixel during an image display operation. The display device further comprises a voltage drop detector electrically connected to an end of the first data line and an end of the second data line, wherein the voltage drop detector is configured to apply a test voltage to the end of the first data line and measure a dropped test voltage at the end of the second data line. The display device further comprises a line resistance calculator configured to calculate i) a first line resistance between the end of the first data line and the first pixel and ii) a second line resistance between the end of the second data line and the second pixel.

In the above display device, the display panel driver is further configured to i) transmit a first compensated data voltage to the first pixel based at least in part on the first line resistance so as to compensate a first data voltage provided to the first pixel and ii) transmit a second compensated data voltage to the second pixel based at least in part on the second line resistance so as to compensate a second data voltage provided to the second pixel.

In the above display device, the display panel comprises a first area and a second area divided by a virtual reference line, wherein the first and second pixels are included in the first area.

In the above display device, the pixels comprise a third pixel, electrically connected to a third data line in the second area, and a symmetrical pixel in the first area substantially symmetrical to the third pixel with respect to the virtual reference line.

In the above display device, the line resistance calculator is further configured to calculate a third line resistance between an end of the third data line and the third pixel to be substantially the same as a symmetrical resistance calculated between an end of the symmetrical data line and the symmetrical pixel, wherein the symmetrical data line is electrically connected to the symmetrical pixel.

In the above display device, the display panel driver is further configured to transmit a third compensated data voltage to the third pixel based at least in part on the symmetrical resistance so as to compensate a third data voltage to be provided to the third pixel.

In the above display device, the line resistance calculator is further configured to calculate a fourth line resistance between an end of the fourth data line and a fourth pixel based at least in part on interpolation of the first and second line resistances.

In the above display device, the display panel driver is further configured to transmit a fourth compensated data voltage to the fourth pixel based at least in part on the fourth line resistance so as to compensate a fourth data voltage to be provided to the fourth pixel.

In the above display device, the display panel comprises first and second area divided by a virtual reference line, wherein the first, second, and fourth pixels are included in the first area.

In the above display device, the pixels comprise a fifth pixel, electrically connected to a fifth data line in the second area, and a symmetrical pixel in the first area substantially symmetrical to the fifth pixel with respect to the virtual reference line.

In the above display device, the line resistance calculator is further configured to calculate a fifth line resistance between an end of the fifth data line and the fifth pixel to be substantially the same as a symmetrical resistance between an end of the symmetrical data line and the symmetrical pixel, wherein the symmetrical data line is electrically connected to the symmetrical pixel.

In the above display device, the display panel driver is further configured to transmit a fifth compensated data voltage to the fifth pixel based at least in part on the symmetrical resistance so as to compensate a fifth data voltage provided to the fifth pixel.

In the above display device, the line resistance calculator is included in the timing controller.

In the above display device, the line resistance calculator is included in the display panel driver.

In the above display device, the display panel driver includes a scan driver configured to transmit a first scan signal to the first pixel and a second scan signal to the second pixel and a data driver including the voltage drop detector.

Another aspect is a display device, comprising a display panel driver electrically connected to a plurality of data lines, a timing controller configured to control the display panel driver, and a display panel including a plurality of pixels electrically connected to the data lines, wherein the pixels include a plurality of resistance detection reference pixels and a plurality of normal pixels. The display device also comprises a line resistance detector configured to detect a plurality of first line resistances of the respective data lines between the data driver and the respective resistance detection reference pixels. The display device further comprises a line resistance calculator configured to calculate a plurality of second line resistances of the respective data lines between the data driver and the respective normal pixels based at least in part on the first line resistances.

In the above display device, the line resistance calculator is included in the display panel driver.

In the above display device, the line resistance calculator is included in the timing controller.

In the above display device, the display panel driver is further configured to i) transmit a plurality of first compensated data voltages to the resistance detection reference pixels based at least in part on the respective first line resistances so as to compensate a plurality of first data voltages to be respectively provided to the resistance detection reference pixels, and ii) transmit a plurality of second compensated data voltages to the normal pixels based at least in part on the respective second line resistances so as to compensate a plurality of second data voltages to be respectively provided to the normal pixels.

In the above display device, the line resistance calculator is further configured to estimate the second line resistances based at least in part on interpolation of the first line resistances.

According to at least one of the disclosed embodiments, the display device generates the compensated data voltage based on the detected line resistances of the data lines, so that display luminance changes and unevenness of luminance distribution by the voltage drops of the data voltage can decrease.

DETAILED DESCRIPTION OF CERTAIN INVENTIVE EMBODIMENTS

Data lines have a certain line resistance that is proportional to the distance spanned. Thus, a voltage drop occurs in the data line according to the line resistance. That is, the data voltage generated in a data driver will usually be different from a data voltage that is applied to a pixel of a display device. As a result, the data voltage from the data driver changes according to the relative position of the pixel in the display panel such that display luminance will differ according to pixel position.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
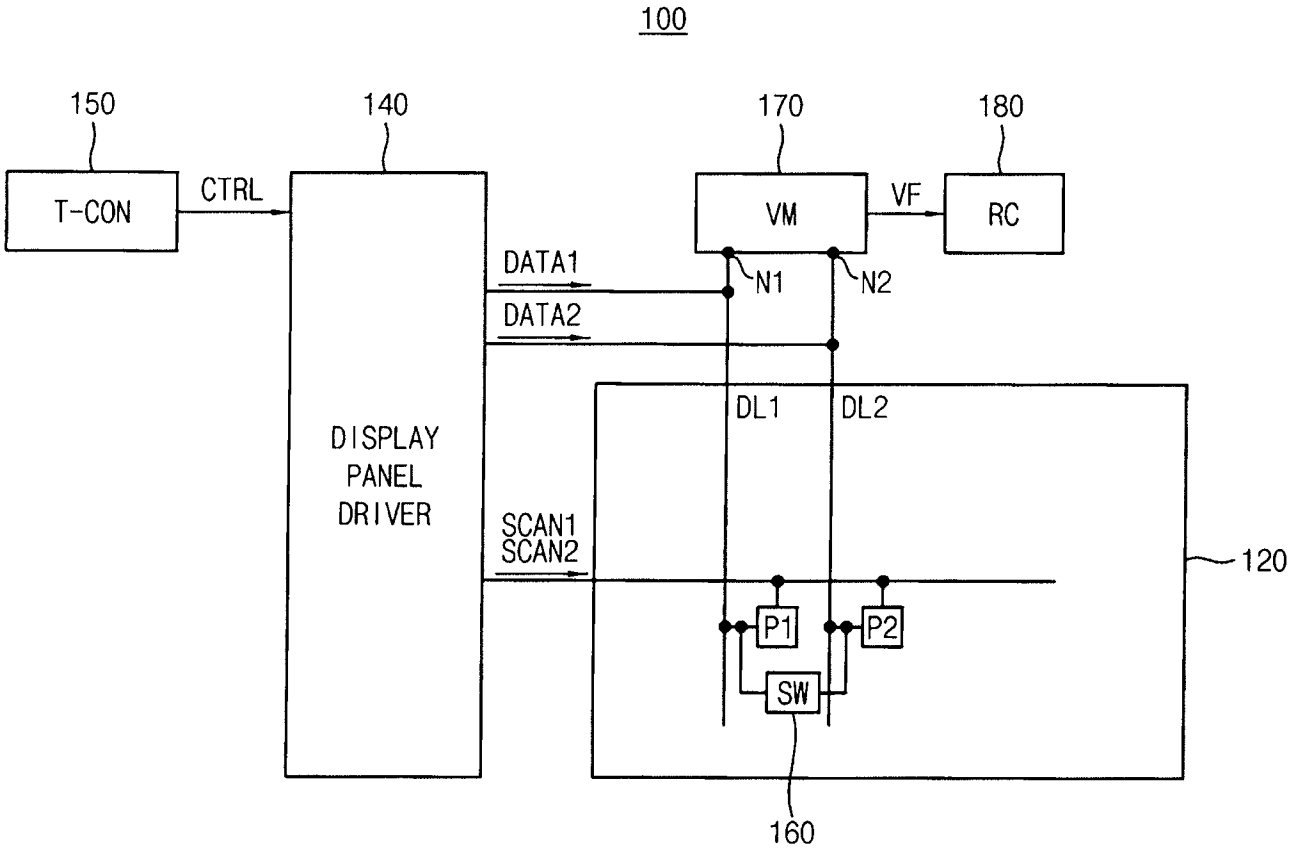
FIG. 1 is a block diagram of a display device according to example embodiments.

FIG. 1 is a block diagram of a display device according to example embodiments.

Referring to FIG. 1, the display device 100 includes a display panel 120, a display panel driver 140, a timing controller 150, a current path switch 160, a voltage drop detector 170, and a resistance calculator 180.

The display panel 120 includes a plurality of pixels P1 and P2. The respective pixels P1 and P2 can emit light based at least in part on a voltage level of a power voltage and voltage level of data voltages DATA1 and DATA2 applied during active periods of scan signals SCAN1 and SCAN2. For example, a driving transistor in each of the pixels P1 and P2 generates a driving current based at least in part on the voltage level of the power voltage and the voltage level of the data voltage DATA1 and DATA2. An organic light-emitting diode (OLED) included in the pixels P1 and P2 can emit light based at least in part on the driving current. The pixels P1 and P2 can include a plurality of sub-pixels. For example, the sub-pixels respectively emit the three primary lights. The sub-pixels can emit light having specific luminance (or specific gray-level) based at least in part on the data voltage DATA1 and DATA2. As a result, the pixel can emit light to have a target color and a target luminance by the combination of the lights from the sub-pixels. The display panel 120 can include a first pixel P1 connected to a first data line DL1 and a second pixel P2 connected to a second data line DL2, and the first and second pixels P1 and P2 are located in the same row.

In some embodiments, the display panel 120 is divided into a first area and a second area by a virtual reference line. The first and second pixels P1 and P2 can be included in the first area. Here, a third pixel connected to a third data line in the second area and a symmetrical pixel in the first area can be substantially symmetric with respect to the virtual reference line.

In some embodiments, the virtual reference line is formed in a substantially horizontal direction of the display panel 120 so that the display panel 120 is divided into an upper side area and a low side area. For example, the upper side area has the same number of pixels as the lower side area.

In some embodiments, the virtual reference line is formed in a substantially vertical direction of the display panel 120 so that the display panel 120 is divided into a left side area and a right side area. For example, the left side area has the same number of pixels as the right side area.

In some embodiments, the display panel 120 further includes a fourth pixel connected to a fourth data line and a fifth pixel connected to a fifth data line. The display panel 120 can be divided into the first area and the second area by the virtual reference line, and the first, second, and fourth pixels can be included in the first area. In contrast, the fifth pixel can be included in the second area. The fifth pixel and a symmetrical pixel in the first area can be substantially symmetric with respect to the virtual reference line.

In some embodiments, the display panel 120 can include a plurality of resistance detection reference pixels and a plurality of normal pixels. The display device 100 can detect line resistances (i.e., data line resistances) from the display panel driver 140 to the respective resistance detection reference pixels, so that the display device 100 can estimate line resistances between the display panel driver 140 and the respective normal pixels.

The display panel driver 140 can drive the display panel 120. In some embodiments, the display panel driver 140 provides a first compensated data voltage to the first pixel P1 based at least in part on a first line resistance to compensate a first data voltage which is provided to the first pixel P1. The first line resistance is a data line resistance from an end N1 of the first data line DL1 to the first pixel P1. The display panel driver 140 can provide a second compensated data voltage to compensate a second data voltage which is provided to the second pixel P2. The second line resistance is a data line resistance between an end N2 of the second data line DL2 and the second pixel P2.

In some embodiments, the display panel driver 140 provides a third compensated data voltage to the third pixel based at least in part on the symmetrical resistance to compensate a third data voltage which is provided to the third pixel. The line resistances in the first area and the line resistances in the second area are substantially symmetric with respect to the virtual reference line. For example, the third pixel connected to a third data line and a symmetrical pixel are substantially symmetric with respect to the virtual reference line. The symmetrical resistance can be a line resistance of a substantially symmetrical data line from an end of the symmetrical data line to the symmetrical pixel, and the symmetrical data line can be connected to the symmetrical pixel. In this, the third pixel and the symmetrical pixel (or the third data line and the symmetrical data line) can be substantially symmetric with respect to the virtual reference line, so that the third line resistance of the third data line from an end of the third data line to the third pixel can be substantially the same as the symmetrical resistance. In some embodiments, the symmetrical pixel corresponds to the first pixel P1 or the second pixel P2.

In some embodiments, the display panel driver 140 provides a fourth compensated data voltage to the fourth pixel based at least in part on a fourth line resistance to compensate a fourth data voltage which is transmitted to the fourth pixel. The fourth line resistance can be estimated by the interpolation method based at least in part on the first and second line resistances. Detailed descriptions of estimating line resistances using the interpolation method will be explained referring to FIG. 6.

In some embodiments, the display panel driver 140 provides a fifth compensated data voltage to the fifth pixel based at least in part on a symmetrical resistance to compensate a fifth data voltage which is provided to the fifth pixel. The fifth pixel connected to a fifth data line in the second area and the symmetrical pixel in the first area can be substantially symmetric with respect to the virtual reference line. The symmetrical resistance can be a line resistance of a symmetrical data line from an end of the symmetrical data line to the symmetrical pixel, and the symmetrical data line can be connected to the symmetrical pixel. In this, the fifth pixel and the symmetrical pixel (or the fifth data line and the symmetrical data line) can be substantially symmetric with respect to the virtual reference line, so that a fifth line resistance of the fifth data line from an end of the fifth data line to the fifth pixel can be substantially the same as the symmetrical resistance. In some embodiments, the symmetrical pixel corresponds to the first pixel P1, the second pixel P2, or the fourth pixel.

In some embodiments, the display panel driver 140 includes a scan driver and a data driver. The scan driver can apply a first scan signal SCAN1 to the first pixel P1, and apply a second scan signal SCAN2 to the second pixel P2. In some embodiments, the first and second scan signals SCAN1 and SCAN2 are substantially the same. The data driver can include the voltage drop detector 170. The data driver can generate a data voltage. The first pixel P1 and the second pixel P2 can respectively receive a first data voltage DATA1 and a second data voltage DATA2 during respective active periods of the scan signals SCAN1 and SCAN2. The first and second pixels P1 and P2 can emit light based at least in part on the first and second data voltages DATA1 and DATA2, respectively.

In some embodiments, the display panel driver 140 is connected to a plurality of data lines DL1 and DL2. The data voltage can be applied to the display panel 120 through the data lines DL1 and DL2.

The timing controller 150 can control the display panel driver 140. The timing controller 150 can control the data driver included in the display panel driver 140 based at least in part on a control signal CTRL which has a serial configuration. For example, the control signal CTRL controls a level of the data voltage, an output timing of the data voltage from the data driver, etc. Further, the timing controller 150 can control the scan driver.

The current path switch 160 can connect the first pixel P1 which is connected to the first data line DL1 to the second pixel P2 which is connected to the second data line DL2 during a voltage drop test operation. The first and second pixels P1 and P2 can be located in the same row. Thus, a current path from the end N1 of the first data line DL1 to the end N2 of the second data line DL2 through the first and second pixels P1 and P2 can be formed.

The current path switch 160 can separate the first pixel P1 from the second pixel P2 during an image display operation. The display panel driver 140 can respectively apply the first and second data voltages to the first and second pixels P1 and P2 during the image display operation.

The voltage drop detector 170 can be connected to the end N1 of the first data line DL1 and the end N2 of the second data line DL2. The voltage drop detector 170 can apply a test voltage to the end N1 of the first data line during the voltage drop test operation. The test voltage can be dropped due to line resistances of the first and second data lines DL1 and DL2. The voltage drop detector 170 can measure the dropped test voltage at the end N2 of the second data line DL2.

The line resistance calculator 180 can calculate the first line resistance of the first data line DL1 from the end N1 of the first data line DL1 to the first pixel P1. The line resistance calculator 180 can calculate a second line resistance of the second data line DL2 from the end N2 of the second data line DL2 to the second pixel P2 based at least in part on a detected voltage VF. In some embodiments, the line resistance calculator 180 calculates the first and second line resistances based at least in part on the Ohm's Law using a voltage difference between the test voltage and the detected voltage VF. In some embodiments, the line resistance calculator 180 calculates the respective resistances referring to a lookup table based at least in part on the voltage difference between the test voltage and the detected voltage VF.

In some embodiments, the line resistance calculator 180 is included in the timing controller 150 such that the data voltage is efficiently compensated by the timing controller 180.

In some embodiments, the line resistance calculator 180 is included in the display panel driver 140 such that compensated data voltages is efficiently applied to the display panel 120 by the display panel driver 140.

In some embodiments, the display device includes a line resistance detector. The line resistance detector can detect a plurality of first line resistances of the respective data lines from the data driver to the respective resistance detection reference pixels. In this, a line resistance calculator can calculate a plurality of second line resistances of the respective data lines from the data driver to the respective normal pixels based at least in part on the first line resistances. For example, the display device detects the first line resistances at some pixels (e.g., the resistance detection reference pixels) and estimates the second line resistances at the other pixels (e.g., the normal pixels) based at least in part on the first line resistances. In some embodiments, the line resistance calculator calculates the second line resistances based at least in part on the interpolation method using the first line resistances. In some embodiments, the resistance detector is included in the display panel driver and the resistance calculator is included in the timing controller. As a result, the display panel driver can respectively provide a plurality of first compensated data voltages to the resistance detection reference pixels based at least in part on the respective first line resistances to compensate a plurality of first data voltages which are respectively provided to the resistance detection reference pixels. The display panel driver can respectively provide a plurality of second compensated data voltages to the normal pixels based at least in part on the respective second line resistances to compensate a plurality of second data voltages which are respectively provided to the normal pixels.

As described above, the display device 100 can generate the compensated data voltage based at least in part on the detected line resistances of the data lines, so that display luminance changes by the voltage drops at the data lines can dramatically decrease.

Figure 2:
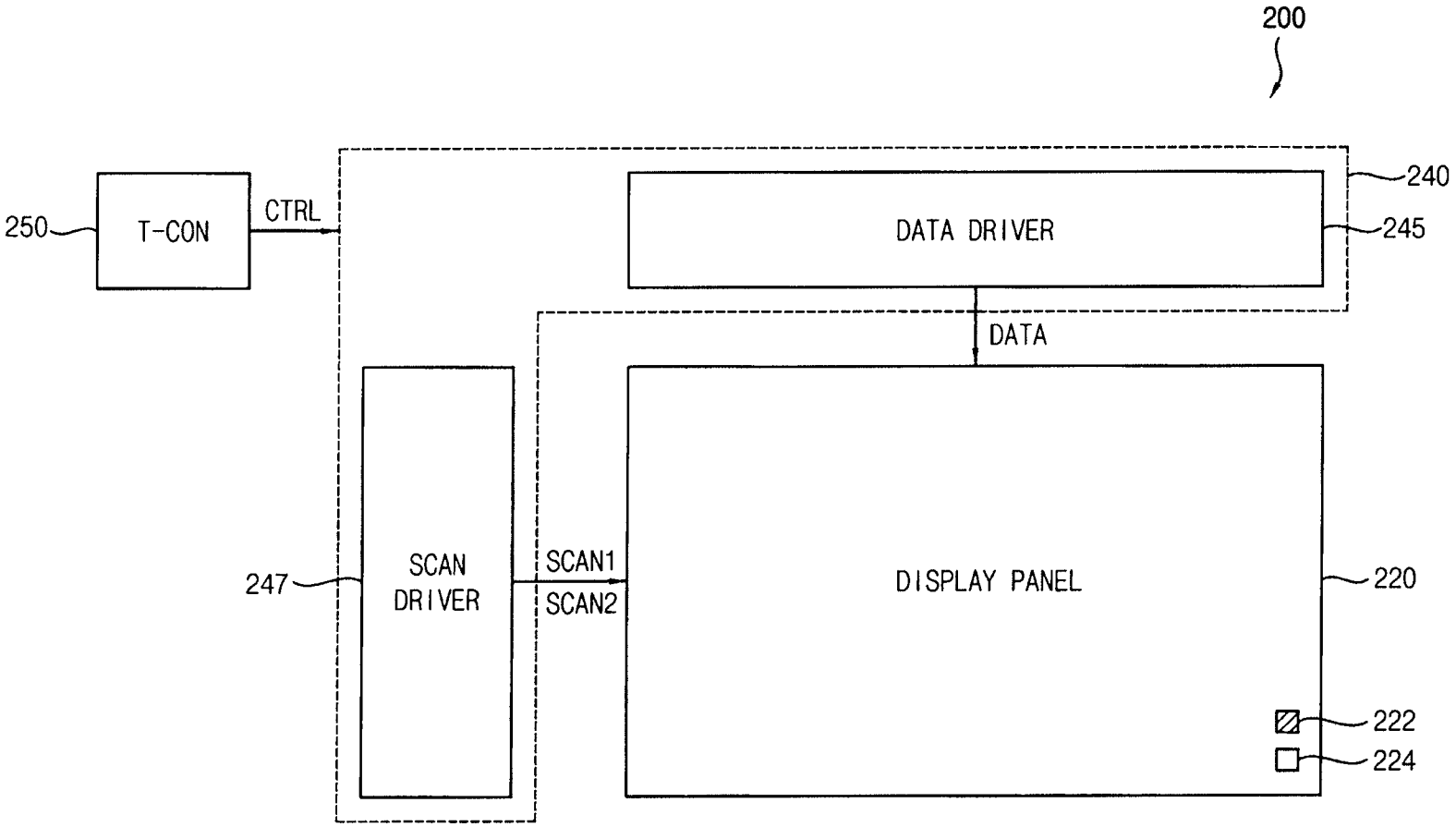
FIG. 2 is a block diagram illustrating a display panel driver in the display device of FIG. 1.

FIG. 2 is a block diagram illustrating an example of the display panel driver 140 in the display device 100 of FIG. 1.

Referring to FIG. 2, the display device 200 includes a display panel 220, a display panel driver 240, a timing controller 250, a current path switch (not shown), a voltage drop detector (not shown), and a line resistance calculator (not shown).

The display panel 220 includes a plurality of pixels. The pixels can include a resistance detection reference pixel 222 and a normal pixel 224.

The display panel driver 240 can include a data drier 245 and a scan driver 247. The scan driver 247 can apply a first scan signal SCAN1 to the resistance detection reference pixel 222, and apply a second scan signal SCAN2 to the normal pixel 224. The data driver 245 can include the voltage drop detector. The data driver 245 can generate a data voltage DATA. The resistance detection reference pixel 222 and the normal pixel 224 can receive the data voltage DATA during respective active periods of scan signals SCAN1 and SCAN2. The resistance detection reference pixel 222 and the normal pixel 224 can emit light based at least in part on the data voltage DATA.

The timing controller 250 can control the display panel driver 240. For example, the timing controller 250 controls the display panel driver 240 based at least in part on a control signal CTRL. The control signal can have a serial configuration.

Figure 3:
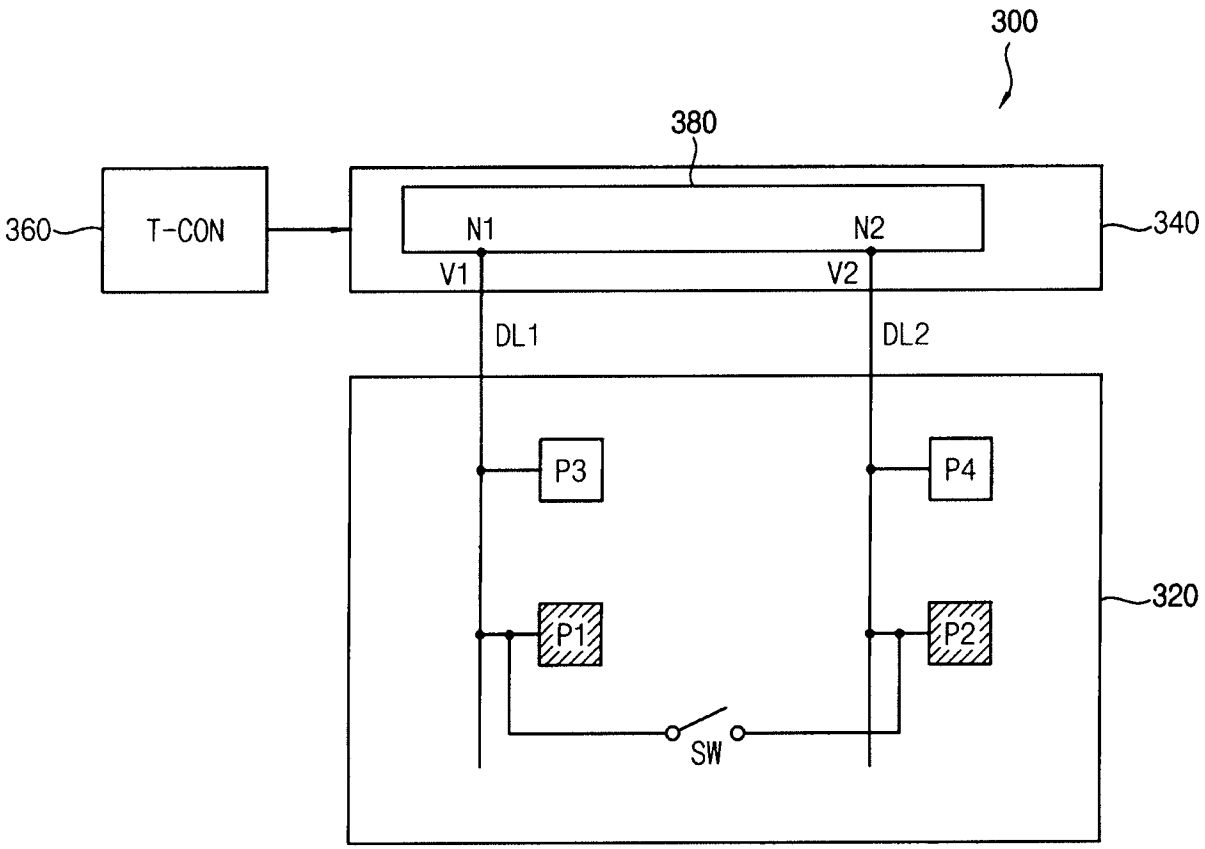
FIG. 3 is a diagram illustrating of a voltage drop detector in the display device of FIG. 1 measuring a dropped voltage at a data line.

FIG. 3 is a diagram illustrating the voltage drop detector in the display device of FIG. 1 measuring a dropped voltage at a data line.

Referring to FIG. 3, the display device 300 includes a display panel 320, a display panel driver 340, a timing controller 360, and a current path switch SW. The display panel 320 can include a first pixel P1 and a second pixel P2 as resistance detection reference pixels. The display panel 320 can further include a third pixel P3 and a fourth pixel P4 as normal pixels. The display panel driver 340 can include a voltage drop detector 380.

The voltage drop detector 380 can apply a test voltage V1 to a first data line DL1 when a voltage drop test operation is performed. The current path switch SW can connect the first pixel P1 to the second pixel P2 during the test operation period. Thus, a current path from a node (or an end) N1 of the first data line DL1 to a node (or an end) N2 of the second data line DL2 is formed through the current path switch SW. The voltage drop detector 380 can detect a dropped test voltage V2 at the end N2 of the second data line DL2 (e.g., the node N2 of the second data line DL2 connected to the voltage drop detector 380), so that the voltage drop at the first and second data lines DL1 and DL2 is detected. The line resistance calculator can calculate a line resistance of the first data line DL1 and a line resistance of the second data line DL2 based at least in part on the voltage drop. In some embodiments, the line resistance calculator calculates the respective line resistances based at least in part on Ohm's Law. In some embodiments, the line resistance calculator calculates the respective line resistances referring to a lookup table. Meanwhile, the line resistance calculator can determine the line resistance of the first data line DL1 is substantially the same as the line resistance of the second data line DL2.

Further, a line resistance from the end N1 of the first data line DL1 to a third pixel P3 and a line resistance from the end N2 of the second data line DL2 to a fourth pixel P4 can be estimated by an interpolation method. In some embodiments, the line resistance from the end N1 of the first data line DL1 to the third pixel P3 is estimated by a linear interpolation based at least in part on the line resistance from the end N1 to the first pixel P1 and the line resistance from the end N2 to the second pixel P2. In some embodiments, the line resistance from the end N1 to the third pixel P3 is estimated by a non-linear interpolation based at least in part on the line resistance from the end N1 to the first pixel P1 and the line resistance from the end N2 to the second pixel P2. Detailed description of example embodiments of estimating line resistances of the data lines will be explained referring to FIG. 6.

Figure 4:
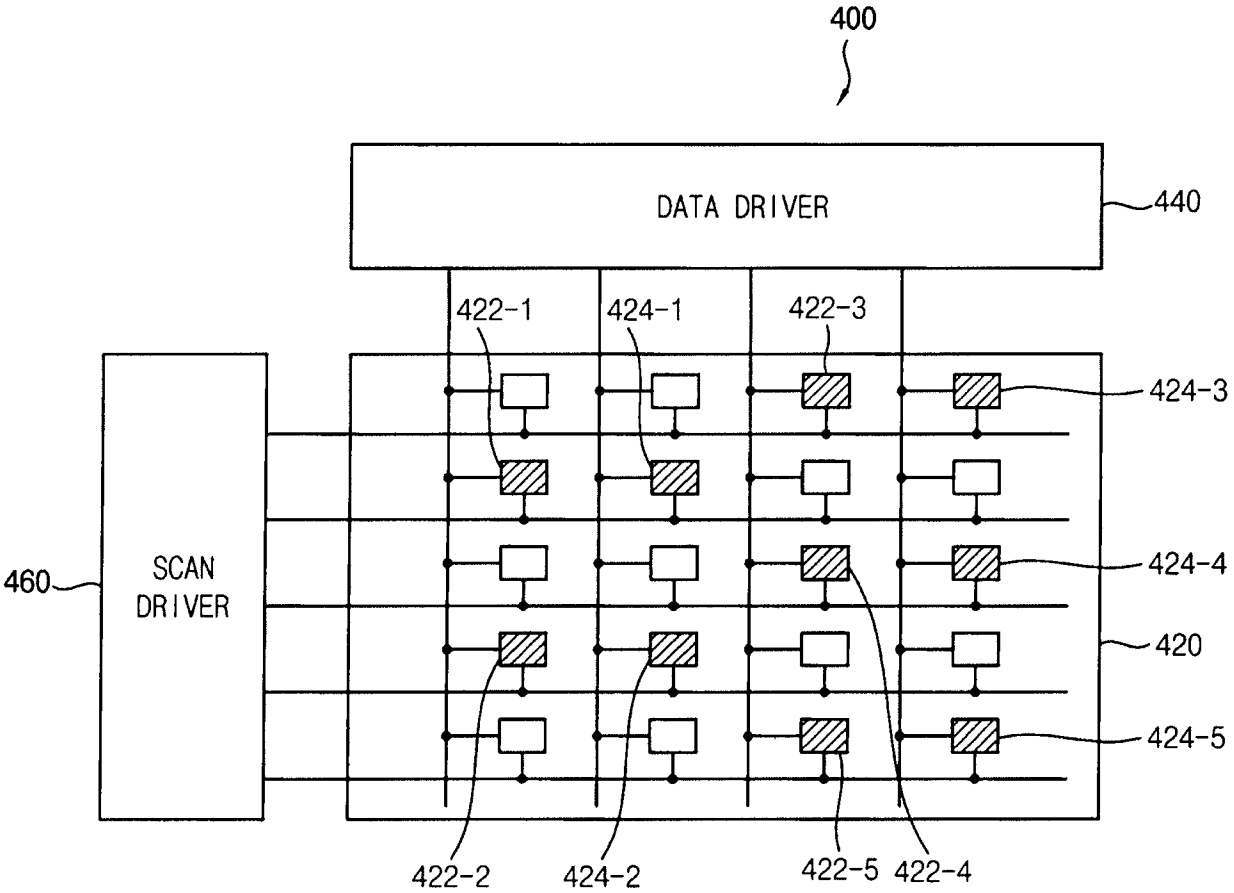
FIG. 4 is a diagram illustrating an arrangement of first and second pixels in the display device of FIG. 1.
Figure 5:
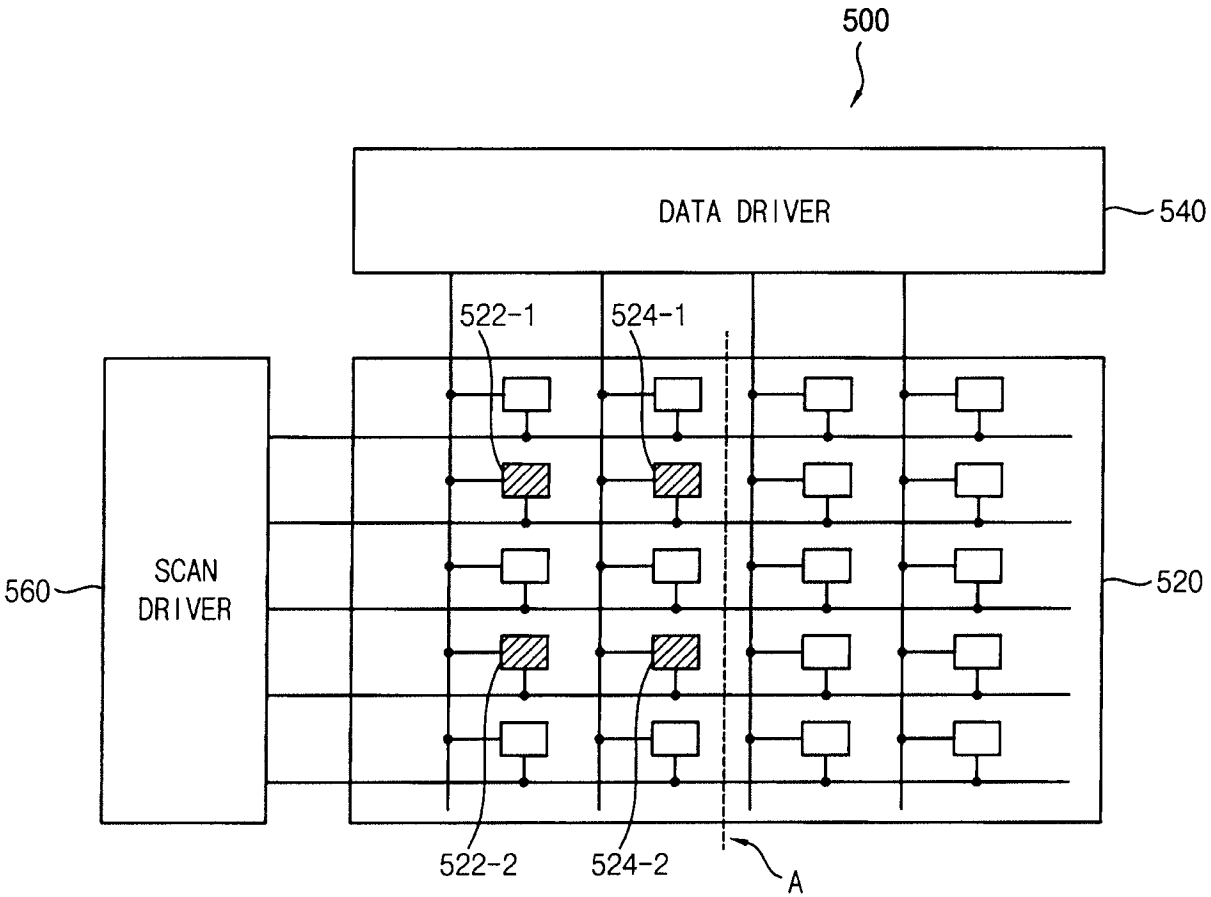
FIG. 5 is a diagram illustrating the display panel of FIG. 1 measures a line resistance of a data line.

FIG. 4 is a diagram illustrating an example of an arrangement of the first and second pixels P1 and P2 in the display device 100 of FIG. 1. FIG. 5 is a diagram illustrating the display panel 100 of FIG. 1 measuring a line resistance of a data line.

Referring to FIG. 4, the display device 400 includes a display panel 420, a data driver 440, and a scan driver 460.

The display panel 420 can include a first pixel 422-1 trough 422-5 and a second pixel 424-1 through 424-5 as resistance detection reference pixels. The display device 420 can measure a line resistance between an end of a data line connected and the first pixel 422-1 through 422-5 to the first pixel 422-1 through 422-5 and a line resistance between an end of a data line connected and the second pixel 424-1 through 424-5 to the second pixel 424-1 through 424-5. Line resistances related to other pixels except for the first and second pixels 422-1 through 422-5, and 424-1 through 424-5 can be estimated by the interpolation method. As illustrated in FIG. 4, all of the data lines are respectively connected to the first pixel 422-1 through 422-5 or the second pixel 424-1 through 424-5. However, in some embodiments, the display device 400 includes at least one data line which is not connected to the first and second pixels 422-1 through 422-5, and 424-1 through 424-5.

Referring to FIG. 5, the display device 500 includes a display panel 520, a data driver 540, and a scan driver 560. The display panel 520 can include a first pixel 522-1 and 522-2 and a second pixel 524-1 and 424-2 as the resistance detection reference pixels.

As illustrated in FIG. 5, the first and second pixels 522-1, 522-2, 524-1, and 424-2 are formed on the left side (e.g. in a first area of the display panel 520) of a virtual reference line A. The display panel 520 can be divided into two areas (e.g., a first area and a second area) by the virtual reference line A. The first area and the second area can be substantially symmetric with respect to the virtual reference line A so that the number of pixels in the first area can be the same as the number of pixels in the second area. Thus, line resistances of a first data line in the first area can be substantially the same as line resistances of a second data line in the second area. For example, the line resistances of the second data line is determined to be substantially the same as the line resistances of the first data line when the line resistances of the first data line are calculated. As a result, circuits for detecting line resistances of the data lines in the second area can be omitted such that manufacturing cost can be reduced and driving efficiency can be improved.

Figure 6:
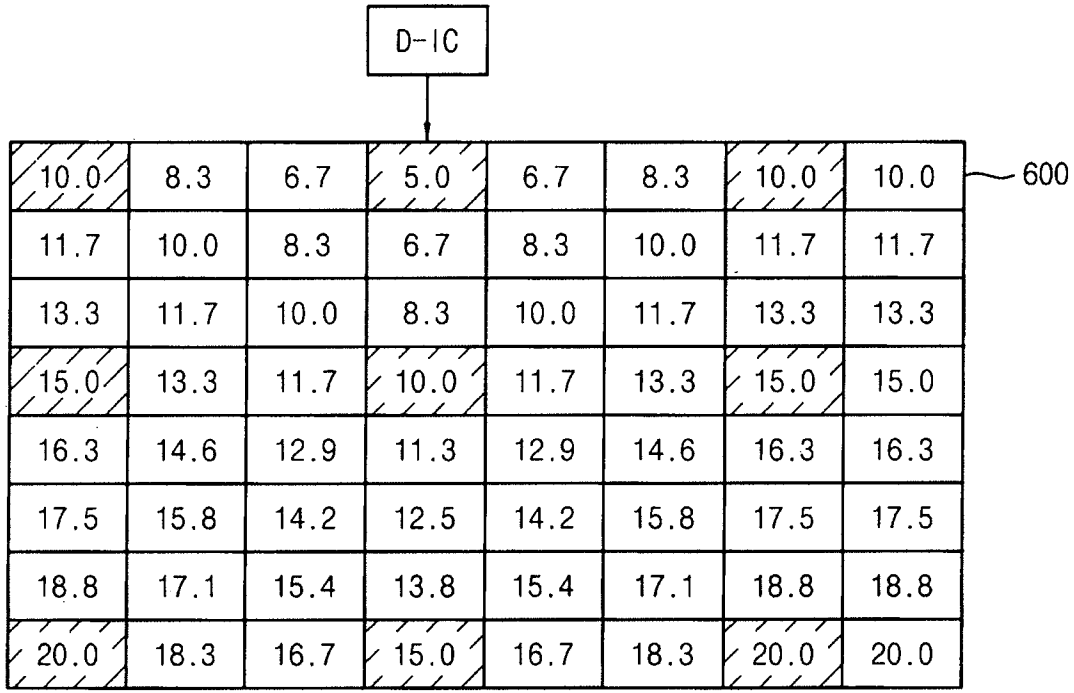
FIG. 6 is a diagram illustrating of a line resistance calculator in the display panel of FIG. 1 estimating a line resistance based on an interpolation method.

FIG. 6 is a diagram illustrating the line resistance calculator in the display panel 120 of FIG. 1 estimating a line resistance based at least in part on the interpolation method.

Referring to FIG. 6, line resistances of respective data lines (or data line resistances) between a data driver D-IC and respective pixels can be determined by the line resistance calculator. The line resistance can increase, as a distance between the data driver D-IC and a pixel receiving a data voltage form the driver D-IC increases. For example, line resistances (or a resistance of a data line) detected at respective first pixels are about 10.0 Ohms (in a first row), about 15.0 Ohms (in a fourth row), and about 20.0 Ohms (in an eighth row). Line resistances detected at respective second pixels can be about 5.0 Ohms (in the first row), about 10.0 Ohms (in the fourth row), and about 15.0 Ohms (in the eighth row), respectively. In this case, respective line resistances of other data lines corresponding to the first row can be about 10.0 Ohms, about 8.3 Ohms, about 6.3 Ohms and about 5.0 Ohms by the interpolation method. Respective line resistances of the data lines corresponding to the fourth row can be about 15.0 Ohms, about 13.3 Ohms, about 11.7 Ohms and about 10.0 Ohms by the interpolation method, respectively. Respective line resistances of data lines corresponding to a second row can be about 11.7 Ohms, about 10.0 Ohms, about 8.3 Ohms and about 6.7 Ohms, and respective resistances of data lines corresponding to a third row can be about 13.3 Ohms, about 11.7 Ohms, about 10.0 Ohms and about 8.3 Ohms by the interpolation method, respectively. In some embodiments, a right end data line among the data lines in the display panel 600 is substantially symmetrical to a left end data line with respect to a virtual center line of the display panel 600, so that line resistances of the right end data line can be substantially the same to line resistances of the left end data line. The method described above can calculate line resistances related to all pixels. For example, the resistance calculator of FIG. 1 performs calculations of all the line resistances of respective pixels using the interpolation method.

Figure 7:
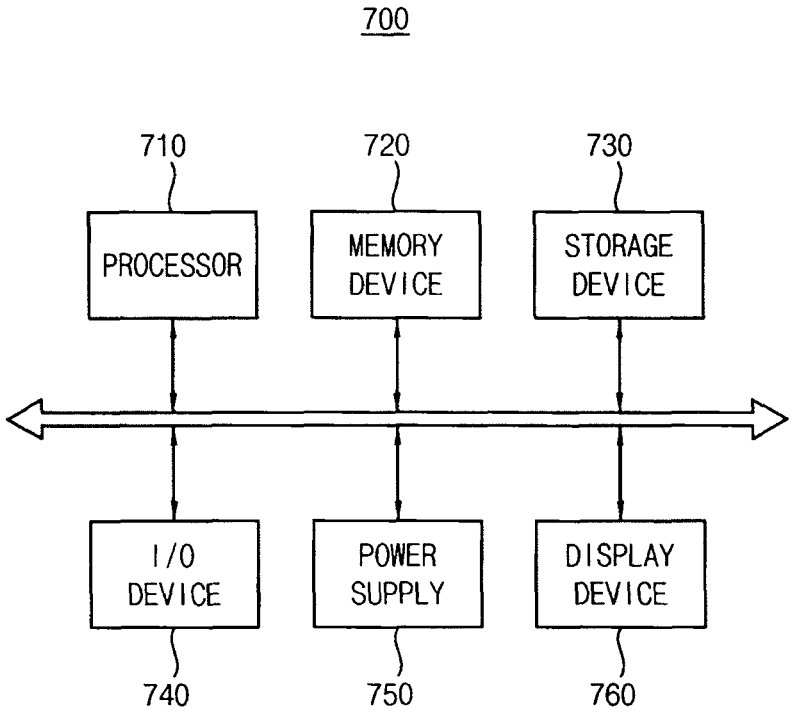
FIG. 7 is a block diagram of an electronic system according to example embodiments.

FIG. 7 is a block diagram of an electronic system according to example embodiments.

Referring to FIG. 7, the electronic system 700 includes a processor 710, a memory device 720, a storage device 730, an I/O device 740, a power supply 750, and a display device 760. The display device 760 can correspond to the display device 100 of FIG. 1. The electronic system 700 can further include a plurality of ports for communicating with a video card, a sound card, a memory card, a universal serial bus (USB) device, and/or other electronic systems.

The processor 710 can perform various computing functions or tasks. The processor 710 is, for example, a microprocessor, a central processing unit (CPU), or other processing device or controller. The processor 710 can be connected to other components via an address bus, a control bus, a data bus, etc. Further, the processor 710 can be coupled to an extended bus such as a peripheral component interconnection (PCI) bus. The memory device 720 can store data for operations of the electronic system 700. For example, the memory device 720 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc. The storage device 730 is, for example, a solid state drive (SSD) device, a hard disk drive (HDD) device, a CD-ROM device, etc. The I/O device 740 is, for example, an input device such as a keyboard, a keypad, a mouse, a touch screen, etc, and/or an output device such as a printer, a speaker, etc. The power supply 750 can supply power for operations of the electronic system 700. The display device 760 can communicate with other components via the buses or other communication links.

As described above, the display device 760 can generate the compensated data voltage based at least in part on the detected line resistances of the data lines, so that display luminance changes by the voltage drops at the data lines can dramatically decrease.

The present embodiments can be applied to any display device and any system including the display device. For example, the present embodiments are applied to televisions, computer monitors, laptops, a digital cameras, cellular phones, smartphones, smart pads, personal digital assistants (PDA), portable multimedia players (PMPs), MP3 players, navigation systems, game consoles, video phones, or other media players that can display images, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display device, comprising:

a display panel including a plurality of pixels comprising a first pixel electrically connected to a first data line and a second pixel electrically connected to a second data line, wherein the first and second pixels are located in the same row;

a display panel driver configured to drive the display panel;

a timing controller configured to control the display panel driver;

a current path switch configured to i) electrically connect the first pixel to the second pixel during a voltage drop test operation, and ii) electrically disconnect the first pixel from the second pixel during an image display operation;

a voltage drop detector electrically connected to an end of the first data line and an end of the second data line, wherein the voltage drop detector is configured to apply a test voltage to the end of the first data line and measure a dropped test voltage at the end of the second data line; and a line resistance calculator configured to calculate i) a first line resistance between the end of the first data line and the first pixel and ii) a second line resistance between the end of the second data line and the second pixel.

2. The display device of claim 1, wherein the display panel driver is further configured to i) transmit a first compensated data voltage to the first pixel based at least in part on the first line resistance so as to compensate a first data voltage provided to the first pixel and ii) transmit a second compensated data voltage to the second pixel based at least in part on the second line resistance so as to compensate a second data voltage provided to the second pixel.

3. The display device of claim 1, wherein the display panel comprises a first area and a second area divided by a virtual reference line, and wherein the first and second pixels are included in the first area.

4. The display device of claim 3, wherein the pixels comprise a third pixel, electrically connected to a third data line in the second area, and a symmetrical pixel in the first area substantially symmetrical to the third pixel with respect to the virtual reference line.

5. The display device of claim 4, wherein the line resistance calculator is further configured to calculate a third line resistance between an end of the third data line and the third pixel to be substantially the same as a symmetrical resistance calculated between an end of the symmetrical data line and the symmetrical pixel, and wherein the symmetrical data line is electrically connected to the symmetrical pixel.

6. The display device of claim 5, wherein the display panel driver is further configured to transmit a third compensated data voltage to the third pixel based at least in part on the symmetrical resistance so as to compensate a third data voltage to be provided to the third pixel.

7. The display device of claim 1, wherein the line resistance calculator is further configured to calculate a fourth line resistance between an end of the fourth data line and a fourth pixel based at least in part on interpolation of the first and second line resistances.

8. The display device of claim 7, wherein the display panel driver is further configured to transmit a fourth compensated data voltage to the fourth pixel based at least in part on the fourth line resistance so as to compensate a fourth data voltage to be provided to the fourth pixel.

9. The display device of claim 7, wherein the display panel comprises first and second area divided by a virtual reference line, and wherein the first, second, and fourth pixels are included in the first area.

10. The display device of claim 9, wherein the pixels comprise a fifth pixel, electrically connected to a fifth data line in the second area, and a symmetrical pixel in the first area substantially symmetrical to the fifth pixel with respect to the virtual reference line.

11. The display device of claim 10, wherein the line resistance calculator is further configured to calculate a fifth line resistance between an end of the fifth data line and the fifth pixel to be substantially the same as a symmetrical resistance between an end of the symmetrical data line and the symmetrical pixel, and wherein the symmetrical data line is electrically connected to the symmetrical pixel.

12. The display device of claim 11, wherein the display panel driver is further configured to transmit a fifth compensated data voltage to the fifth pixel based at least in part on the symmetrical resistance so as to compensate a fifth data voltage provided to the fifth pixel.

13. The display device of claim 1, wherein the line resistance calculator is included in the timing controller.

14. The display device of claim 1, wherein the line resistance calculator is included in the display panel driver.

15. The display device of claim 1, wherein the display panel driver includes:

a scan driver configured to transmit a first scan signal to the first pixel and a second scan signal to the second pixel; and a data driver including the voltage drop detector.

16. A display device, comprising:

a display panel driver electrically connected to a plurality of data lines;

a timing controller configured to control the display panel driver;

a display panel including a plurality of pixels electrically connected to the data lines, wherein the pixels include a plurality of resistance detection reference pixels and a plurality of normal pixels;

a line resistance detector configured to detect a plurality of first line resistances of the respective data lines between the data driver and the respective resistance detection reference pixels; and a line resistance calculator configured to calculate a plurality of second line resistances of the respective data lines between the data driver and the respective normal pixels based at least in part on the first line resistances.

17. The display device of claim 16, wherein the line resistance calculator is included in the display panel driver.

18. The display device of claim 16, wherein the line resistance calculator is included in the timing controller.

19. The display device of claim 18, wherein the display panel driver is further configured to i) transmit a plurality of first compensated data voltages to the resistance detection reference pixels based at least in part on the respective first line resistances so as to compensate a plurality of first data voltages to be respectively provided to the resistance detection reference pixels, and ii) transmit a plurality of second compensated data voltages to the normal pixels based at least in part on the respective second line resistances so as to compensate a plurality of second data voltages to be respectively provided to the normal pixels.

20. The display device of claim 19, wherein the line resistance calculator is further configured to estimate the second line resistances based at least in part on interpolation of the first line resistances.

* * * * *